United States Patent [19]

Gratzmuller

[11] 4,026,523

[45] May 31, 1977

[54] HYDRAULIC JACKS

[76] Inventor: Jean Louis Gratzmuller, 33 Bld Maurice Barres, Neuilly sur Seine, France, 92000

[22] Filed: June 30, 1976

[21] Appl. No.: 701,012

[30] Foreign Application Priority Data

July 7, 1975 France ..... 75.21211

[52] U.S. Cl. ..... 254/93 R; 91/396

[51] Int. Cl.[2] ..... B66F 3/32

[58] Field of Search ..... 254/93 R; 91/396, 395, 91/394

[56] References Cited

UNITED STATES PATENTS 2,493,602 1/1950 Sterrett ..... 91/396

*Primary Examiner*—James L. Jones, Jr.
*Assistant Examiner*—Robert C. Watson
*Attorney, Agent, or Firm*—Cantor and Singer

[57] ABSTRACT

The invention relates to hydraulic jack operating systems. The end-of-stroke damping of the jack is produced by an element of the shape of a truncated cone, integral with the stem of the jack, which penetrates into a floating ring and which defines, in this ring, a damping chamber isolated from the remainder of the capacity of the jack. When the stem of the jack makes its return movement, the chamber is re-supplied with oil through passages which were previously obturated by the displacement of the ring at the instant of the damping. The invention is applicable to high speed hydraulic controls for circuit breakers with ultra-rapid operation.

10 Claims, 4 Drawing Figures

HYDRAULIC JACKS

The present invention relates to hydraulic jacks and, more particularly, but not exclusively, to hydraulic jacks used for the operation of electric circuit breakers.

For several years, in certain applications of hydraulic jacks, it has been sought to increase the speed of working and, moreover, the masses to be carried along are often more considerable than in times past. This is the case, for example, with rapidly-opening electric circuit breakers with high and very high voltage. To achieve these results, it has been necessary, inter alia, to increase the pressure of the hydraulic fluid supplying the jacks but, because of the increasing of the speeds and masses in movement, it has also been necessary to provide systems for damping at the ends of strokes in order to limit the shocks at each operation.

It is advantageous that these damping systems (hydraulic damping devices or "dash-pots") be incorporated in the jacks in order not to increase unduly the space occupied by and the cost of these apparatusses.

There are already known hydraulic jacks with incorporated damping devices in which a tapered component, connected, for example, to the piston of the jack, penetrates, at the end of stroke, into a damping ring mounted at one of the ends of the jack. There is thus brought about a braking by throttling of the oil between the ring and the tapered component and by compression of this oil in a chamber of the jack.

A jack with damping device of this kind has been described, for example, in French Pat. application No. 72 14991 filed on 27th Apr., 1972, in the name of the same inventor, this jack offering the advantage that the very high excess pressures which appear at the time of damping (sometimes several thousands of bars) are not transmitted to the gaskets making the jack fluid-tight (which gaskets would incur the risk of being destroyed) nor to the cylinder itself, these excess pressures being confined in a special damping chamber which, at the time of the damping, is isolated from the capacity of the jack.

It has become evident that, in the event of high operational speeds (for example 10 to 15 m/sec) and in the event of the stroke of the jack being relatively small (for example of the order of 100 to 200 mm), the braking had to be effected over a very short distance, for example 10 to 20 mm. This leads to providing a very slight clearance between the male and female damping components, with the result that in the end-of-stroke condition the aforesaid damping chamber is closed in an almost fluid-tight manner with only a very slight leakage. Consequently when re-supply of the jack is initiated to effect operation in the opposite direction, the delivery is only that warranted by the foregoing leakage, with the result that the first part of the return stroke of the jack is slowed down.

To overcome this disadvantage, it has already been proposed (for example in United States Pat. No. 2493602) to make the damping ring play the part of a non-return valve, that is to say that this ring may be displaced longitudinally in the manner of a valve and not prevent the passage of the fluid in the direction opposite to that of its passage in the course of the damping, the passage of the fluid then being either around the ring, or through slots or openings provided in the ring.

Consequently, the re-supply of the jack may take place through a non-throttled passage section. However, the re-supply systems proposed are applicable only to damping systems in which the excess pressures of damping are developed directly in the capacity of the jack and have therefore a harmful effect on the gaskets making the jack fluid-tight, especially the piston gasket. Such re-supply systems are therefore applicable only to jacks operating at moderate pressures, at relatively low speeds and moving only masses which are not very large.

The present invention on the contrary enables the accomplishment of efficient damping and a rapid re-supply with a jack of high operating speed and moving large masses, without the gasket because of this being subjected to any excess pressure.

The subject of the invention is a hydraulic jack with incorporated end-of-stroke damping device, in which the piston is provided with at least a first damping component presenting a male element cooperating at one of the ends of stroke, with a second damping component constituted by a ring floatingly mounted within a seating provided in the jack cylinder, said seating allowing radial wobbling of said ring, while the inner surface of said ring brings about with the outer surface of the male element an annular clearance of variable section for the throttling of the hydraulic fluid, which hydraulic fluid, in the course of the end-of-stroke damping, leaks from an annular chamber of variable volume, or damping chamber, delimited, in the axial direction, by an annular radial surface of the ring and by the opposed annular radial surface of the first component. According to the invention, said seating also enables an axial wobbling of the ring and the ring has based therein through-going passages for re-supply of said damping chamber, said passages being arranged substantially parallel to the axis of the jack. These passages, in the damping position of the ring, are obturated by coming to rest through one of their open ends in a fluid-tight manner against a stationary annular surface integral with the jack and which constitutes the extreme wall surface of said seating against which the ring is supported in the course of the damping. This obstruction of the passage isolates the independent damping chamber in a fluid-tight manner.

On the contrary, when the piston returns in the opposite direction, the ring is displaced, which results in discontinuance of the obturation of the passages and makes possible the free re-supply of the jack through these passages.

The passages provided in the ring may have the form of slots cut into the periphery of the ring or else ducts pierced through this ring.

The invention will be better understood on reading the detailed description which follows and examining the accompanying drawings, given by way of non-limiting example, and which show various embodiments of the invention.

Figure 1:
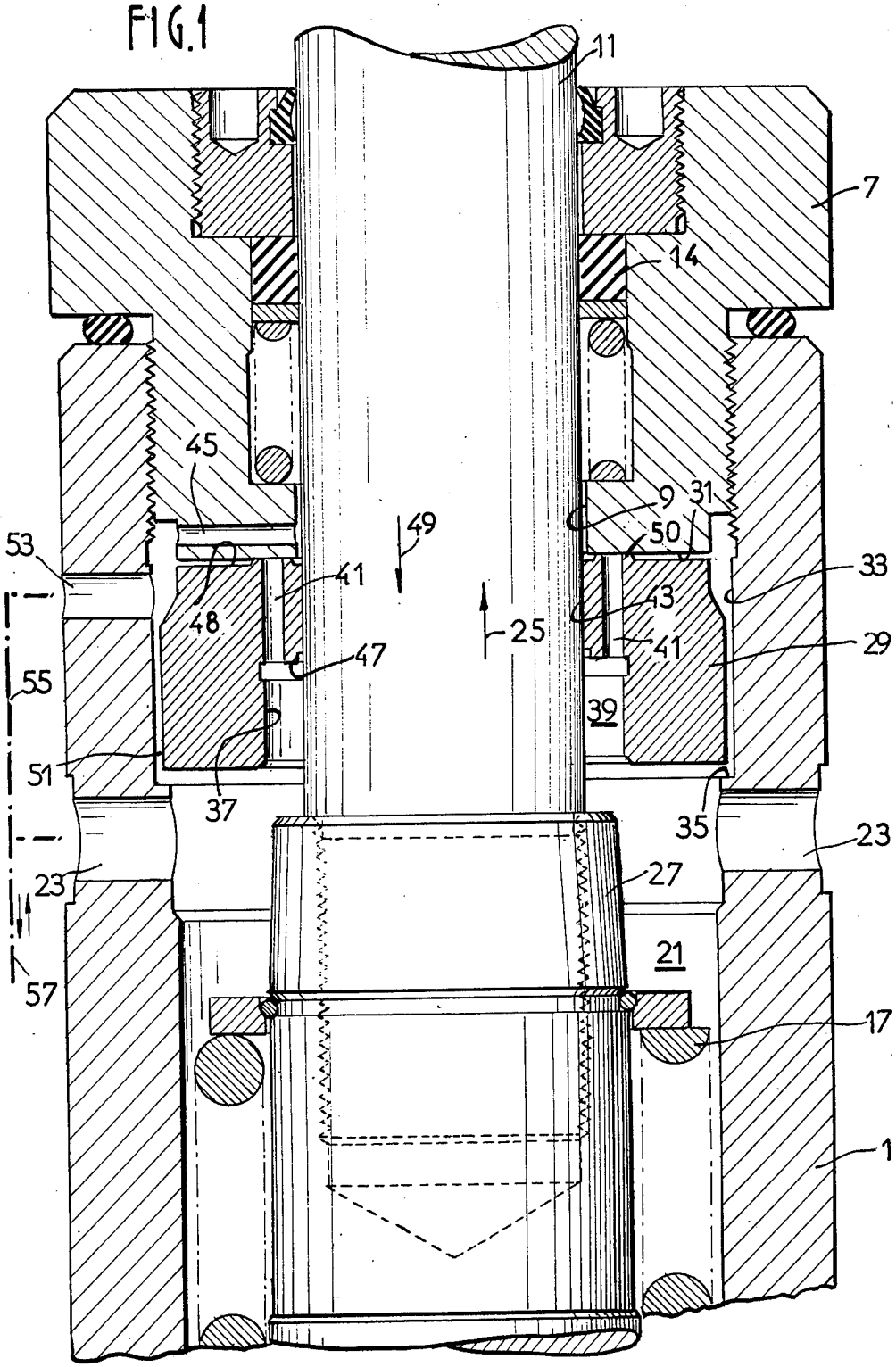
FIG. 1 is a partial view in axial section of a hydraulic jack according to the invention showing the apparatus carrying out its outward travel, in a position preceding the onset of damping.

The jack comprises a cylinder 1 which is closed, at one end, by a bottom 3, penetrated by a port 5 for admission and purging of oil under pressure (FIG. 2), and at its other end by a head 7 (FIG. 1) penetrated by a bore 9 in which the stem 11 of the jack slides, the fluid-tightness on the passage of the stem being assured by a gasket 14, preferably of the spring-loaded type just as is usual in high-pressure jacks.

The stem 11 carries the piston 13 of the jack, the piston being provided with a gasket 15 (FIG. 2) preferably also kept compressed by a spring 17.

The jack shown by way of example is a double-acting jack the lower chamber 19 of which (in the drawings) is supplied and purged through the port 5 which the upper chamber 21 is supplied and purged through ports 23. The ports 5 and 23 are joined up with hydraulic conduits provided with suitable valves for supplying one or the other of the jack chambers. Of course, the port 5 could be provided in the cylinder 1 and not in the bottom 3.

In one preferred application, the stem 11 operates the movable contact of an electric circuit breaker.

There will now be described the damping system which is operative at the end of outward travel of the stem 11, that is to say that which is shown in FIG. 1 and which is operative when the piston stem is displaced in the direction of the arrow 25.

This system comprises a first damping member, constituted by a male element 27 of slightly frusto-conical shape (or of sections arranged in tiers), which cooperates with a second damping member constituted by a ring 29 floatingly mounted within a seating provided in the cylinder. This seating is bounded in the case shown, by the lower annular surface 31 of the bottom 7, by a portion 33 of the internal cylindrical surface of the cylinder 1 and by an annular recess 35 out into the inside wall surface of the cylinder.

Just as is known, the seating affords scope for radial wobble of the ring in order that the latter is freely centred on the stem 11 and consequently on the male element 27 which is integral with the latter.

At the end of stroke, the element 27 penetrates into the bore 37 of the ring 29, this giving rise to an annular gap of variable section for throttling of oil. This narrow gap is the only leakage passage for the oil contained in the annular damping chamber 39, very high over-pressures being set up in the chamber 39 at the instant of the damping.

In accordance with the invention the aforesaid seating for the ring also affords scope for undulation of the ring in the axial direction, thanks to the play existing between the ring and the step 35. Moreover, re-supply passages 41 are made in the ring 29 and extend substantially parallel to the axis of the jack.

In the damping position of the ring 29 (position shown in FIG. 1), that is to say when the stem 11 is displaced in the direction of the arrow 25 and when the oil contained in the chamber 21 of the jack is forced back out of the ports 23 by the piston, the ring 29 is applied by the pressure of oil against the surface 31 of the bottom 7 of the cylinder. In this position the passages 41 are abturated by their ends resting on the surface 31.

Thanks to this obturation of the passages 41, the damping chamber 39 is completely independent of and isolated from the capacity of the jack, with the result that the excess pressures which prevail therein are not transmitted to the gaskets 14 and 15 of the jack, nor even to the cylinder itself of the jack. This is a very considerable advantage as, for a jack having a stroke of about 10 to 20 mm and with a speed of displacement of the stem of 10 to 15 m/sec., the excess pressures in the chamber 39 on damping may attain many thousands of bars.

The leakage which may occur, at the instant of the damping, between the stem 11 and the bore 43 of the ring, may be collected through a duct 45 bored in the head 7 and which communicates therefore with the chamber 21 of the jack which is at a relatively low pressure during the damping. These leakages cannot therefore bring any influence to bear on the gasket 14.

At the end of damping, the male element 27 comes into abutment against the annular surface 47 of the ring with the result that the variable volume of the damping chamber 39 is substantially zero.

When the piston operation is controlled in the opposite direction, that is to say in the direction of the arrow 49, the male element 27, which moves back, tends to put the chamber 39 into reduced pressure, with the result that the ring 29 is carried along in the same direction, until it comes into abutment against the step 35.

Because of this falling back of the ring, the ends of the passages 41 are no longer obturated by resting on the surface 31, with the result that the chamber 39 which was isolated from the capacity of the jack during the damping, is put back into communication with this capacity and may therefore be re-supplied with oil, through these openings.

It should be noted that, in order to facilitate this falling back of the ring 29, the upper surface 48 of this ring is slightly recessed with regard to the surface 50 at the upper end of the passages 41, that is the surface which is applied in at fluid-tight manner against the facing surface 31 of the head 7. This set-back disposition of the major portion of the upper surface of the ring prevents the vacuum effect, which could be produced between surfaces applied against one another.

Thanks to the re-supplying of the chamber 39 through the passages 41, the first part of the backwards travel of the jack (corresponding to the male element 27 coming out of the bore 37 of the ring 29) is not slowed down since the re-supplying of the chamber 39 can take place through the aggregate section of the passages 41, instead of taking place only through the narrow annular gap existing between the element 27 and the bore 37.

The return of oil from the chamber 21 of the jack towards the space existing between the surfaces 48 and 31 and towards the openings 41 may take place through the annular clearance 51 existing between the ring and the cylinder 1 (this clearance affording scope for the radial wobble of the ring to which reference has been made hereinbefore) but there may also be provided, as is shown in FIG. 1, a re-supply port 53 which opens directly into the cylinder in the vicinity of the recessed surface 48 of the ring 29. There is thus brought about a larger passage section for the oil which re-supplies the damping chamber 39, this enabling the withdrawal operation to be carried out at high speed.

These circumstances are important in the event that circuit-breakers are operated.

The re-supply port 53 is joined in parallel with the ports 23, for example by means of an external pipe branched on to the supply pipeline (or supply-purge pipeline) 57 of the chamber 21 of the jack.

The invention is applicable to plunged-piston jacks, to single-acting jacks and to double-acting jacks whether or not differential, the damping being effected at one or both ends of a stroke.

There will now be described, with regard to FIG. 2, a modification of the damping system with re-supply which may be applied at the other end of the stroke of the differential jack shown in FIG. 1.

Figure 2:
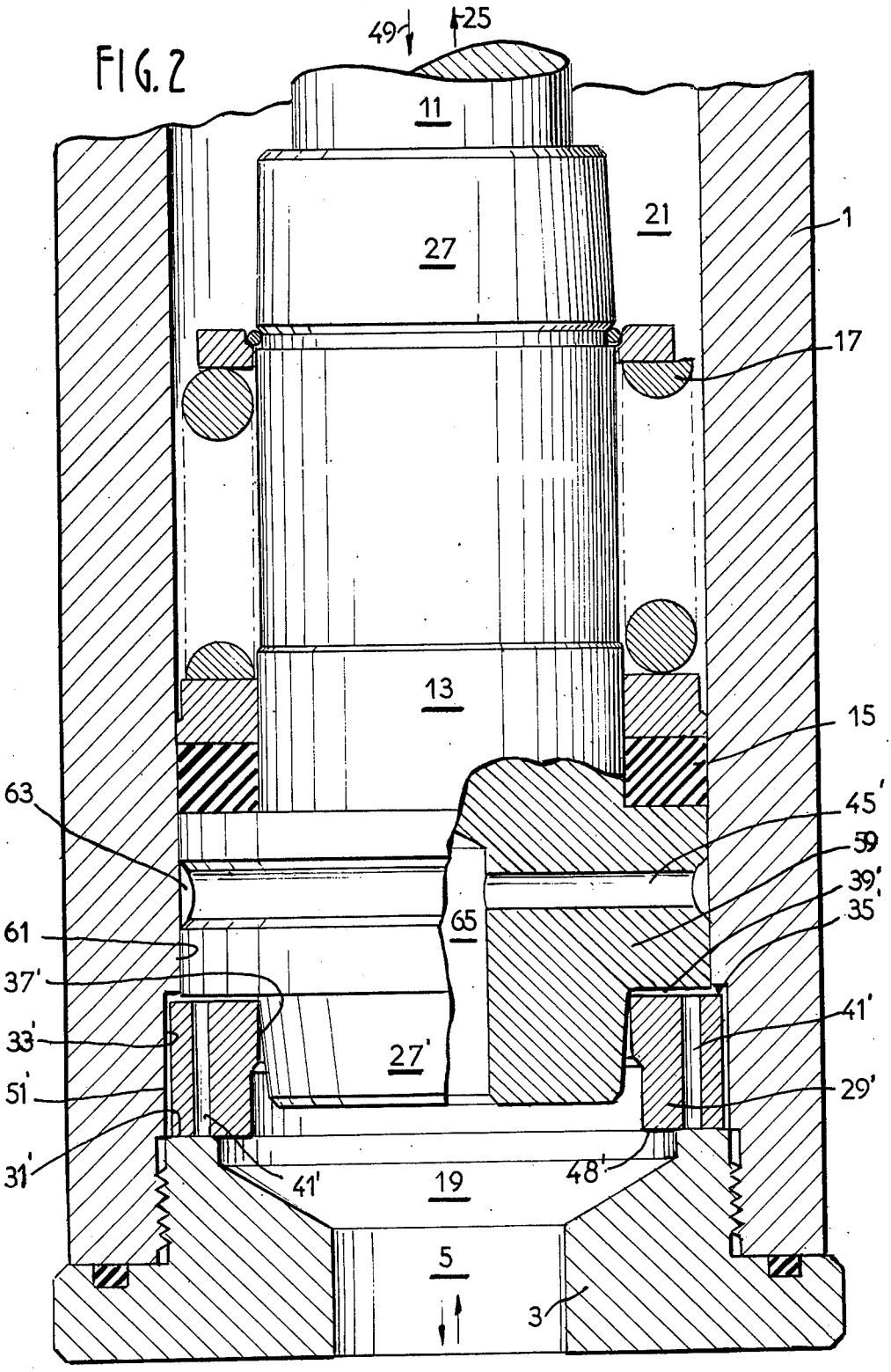
FIG. 2 is a partial view in axial section, showing the other end of the same jack but with the components shown in the corresponding position approaching the end of retraction of the apparatus.

The same parts are identified in FIG. 2 with the same reference numerals as in FIG. 1, but with the prime index.

The piston 13 carries a first damping component comprising a male element 27′ (of frusto-conical shape or of stepped section) and an intermediate element 59 which slides in the cylinder 1. The two elements of the first damping component cooperate with the second damping component constituted by a ring 29′ floatingly mounted (radially and axially) as is the ring 29.

The ring 29 is pierced by re-supply passages 41′ which, in the damping position shown in FIG. 2, are obturated by having come to rest in a fluid-tight manner against the annular rim 31′ of the bottom 3 of the jack.

In this position, the damping chamber 39′, of variable volume, in which the excess damping pressures are developed, is thus completely independent of and isolated from the capacity of the jack, with the result that, there again, there is no danger of any harmful excess pressure destroying the gasket 15 of the piston 1.

The possible leakages of oil coming from the damping chamber, which could take place between the outer cylindrical surface 61 of the intermediate element 59 and the cylinder 1 are collected in a groove 63 into which open radial ducts 45′ joined to an axial duct 65. This axial duct opens, at the centre of the male element 27′, into the lower chamber 19 of the jack, the latter chamber being at a low pressure (or at least a relatively low pressure) when the piston travels in the direction of the arrow 49. This arrangement (similar to that of the duct 45 described with regard to FIG. 1) ensures that the gasket 15 will not be subjected to any harmful excess pressure.

When the pressure of oil in the lower chamber 19 is restored, in order to effect the stroke of the piston in the opposite direction (that is to say in the direction of the arrow 25), the operation of the damping device is identical to that which has been described with regard to FIG. 1. It requires only to recall that the damping chamber 39′, which has been isolated until now, is again put back into communication with the capacity of the jack, thanks to the fact that the ducts 41′ are no longer obturated, since the ring 29′ is moved away from the rim 31′ of the bottom 3. It should be noted that a portion of the lower surface 48′ of the ring 29′ resting on the rim 31′ projects with regard to this rim in order that this portion should be subjected to the pressure of the oil introduced through the port 5 of the jack. The ring 29′ is thus induced to rise and is not subjected to the effect of sticking through reduced pressure, which would slow down its rising and have the clearance of the passages 41′, if all of the lower surface 48′ of the ring were applied in a fluid-tight manner on the bottom 3 of the jack.

The damping chamber 39′ is therefore re-supplied without restriction through the passages 41′, which communicate directly with the lower chamber 19 of the jack and also through the clearance 51′ existing around the ring 29′. There is avoided in the way the slowing down which would occur if the chamber 39′ were re-supplied only through the narrow annular throttling gap comprised between the male element 27′ and the facing surface 37′ of the ring.

The embodiment of the damping device described with regard to FIG. 2 could, of course, be similar to that described with regard to FIG. 1. In this event the piston would support a tail end sliding in a bore provided in the bottom of the cylinder and playing the same role as the stern of the piston.

Figure 3:
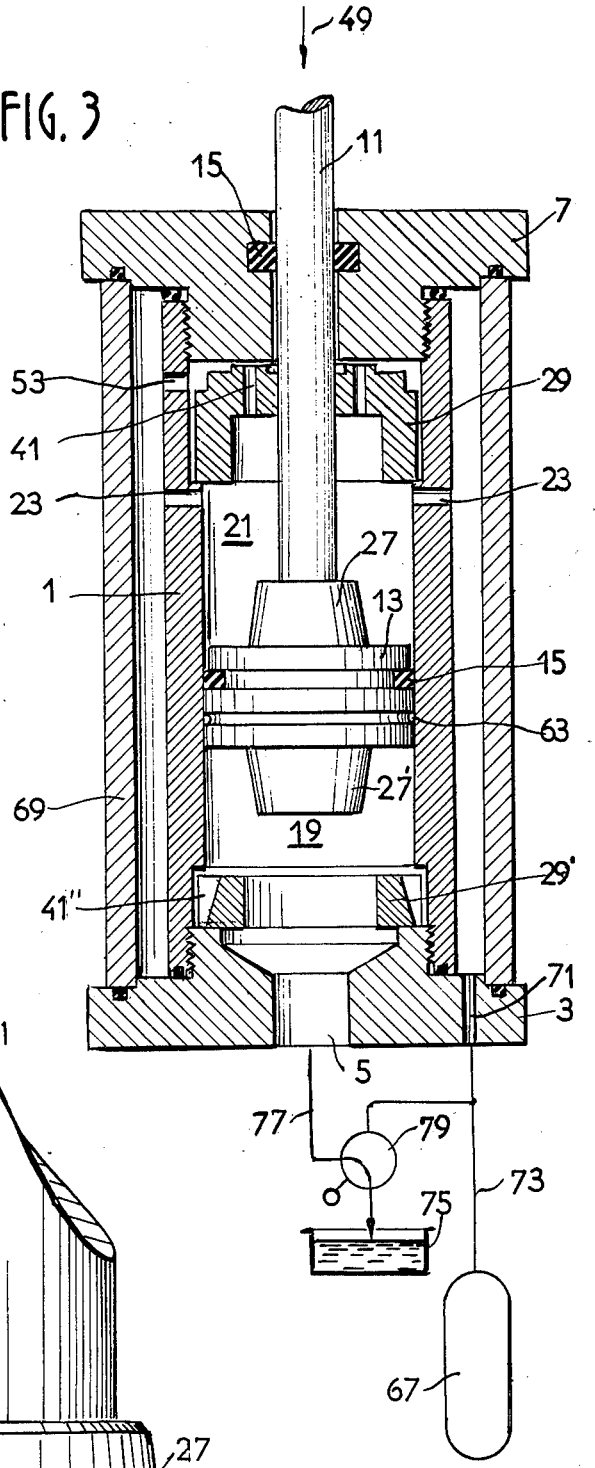
FIG. 3 is a diagrammatic sectional view of a preferred supply system for a differential jack according to the invention with incorporated damping.

Of course, the ducts 41 – 41′ pierced in the rings 29 – 29′ could be replaced by slots cut into the periphery of these rings, as is shown at 41″ for the ring 29′ in FIG. 3.

There is shown, in a simplified manner, in FIG. 3, a jack with incorporated damping devices according to the invention particularly suitable for the operation of the moveable contact of an electric circuit breaker.

In this example, the upper chamber 21 of the jack is permanently connected to a source of oil under pressure, for example a hydro-pneumatic accumulator 67. But whereas this source is directly connected to the port 23 of the jack through an external pipeline 57 (as in the case of FIG. 1), this connection is made by means of an external cylindrical jacket 69 which surrounds the cylinder 1.

A port 71 pierced in the bottom 3 of the jack, or in the jacket 69, is joined up with the pipeline 73 of the accumulator, while the other port 5 of the jack may be joined up selectively with the accumulator or with a low pressure reservoir 75 by means of a pipeline 77 on which is interposed a hydraulic commutation device diagrammatically represented by a three-way valve 79.

In accordance with this arrangement, the piston 13 of the jack is permanently urged downwards by the oil pressure permanently prevailing in the chamber 21. In the condition shown in FIG. 3, the chamber 19 of the jack has been purged and the piston is carrying out its downward stroke (arrow 49), corresponding, in the event that the piston operates a circuit breaker, to the disconnection operation of the circuit breaker.

After the end-of-stroke damping and the abutment of the piston 13 on the damping ring 29′, it is sufficient, in order to cause the piston 13 to move up again (towards the position corresponding to the closing of the circuit breaker) to put the pipeline 77 into communication with the accumulator 67, by means of the valve system 79. After damping in the upper position, the piston remains in this position against the pressure which is permanently exerted on the upper annular surface of the piston. It should be noted that the port 53 pierced in the cylinder 1 in order to re-supply the passages 41 in the ring directly, also opens into the clearance enclosed between the cylinder 1 and the jacket, which clearance is always filled with oil at the pressure in the accumulator 67. There is thus no need for the external pipeline 55 shown in FIG. 1.

Figure 4:
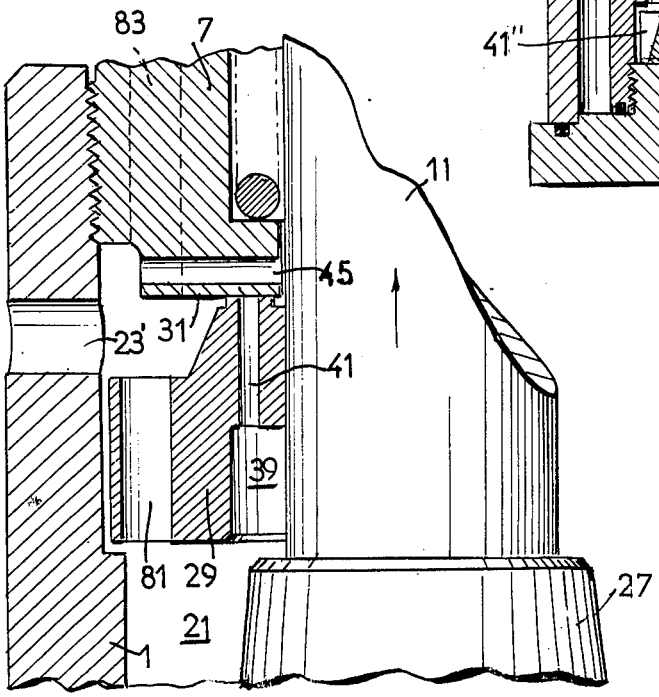
FIG. 4 is a partial view in section of another embodiment of the damping ring in a rack according to the invention.

There is shown in FIG. 4 a portion of the left-hand upper part of FIG. 1 in order to illustrate a modification of the damping ring 29. In accordance with this modification the main supplying of the chamber 21, instead of being effected through a port 23 opening directly into this chamber of the jack, is effected through a port 23' opening above the ring 29, the ring 29 being pierced by ducts 81 of large section. These ducts 81, which are always open, ensure the flow of oil on supply and on purge towards and out of the chamber 21.

As in the embodiments previously described, the passages 41 for re-supply of the chamber 39 are obturated by bearing of their open end on the surface 31 of the head 7 when the ring is in the damping position (other position shown in FIG. 4) and are on the contrary cleared at the instant of starting back of the male element 27 integral with the stem 11 of the jack.

Of course, the supply port 23', which has been shown as being pierced in the cylinder 1 of the jack, could as well be pierced in the head 7 of the jack as has been shown in dotted lines under the reference numeral 83 in FIG. 4.

As this port is pierced at 23' or at 83, it serves as port for supplying both the chamber 21 of the jack and the damping chamber 39, with the result that it is unnecessary to provide two separate ports (23 and 53) as has been described with regard to FIG. 1. Likewise, the duct 45 for evacuation of the leakages may be replaced by countersunk portions in the upper surface 48 of the ring, between the ends of the passages 41.

Of course, the invention is not restricted to the embodiments described and shown, and is capable of numerous modifications within the ambit of the expert, according to the applications considered and without thereby departing from the scope of the invention.

I claim

1. Hydraulic jack with incorporated end-of-stroke damping device in which the piston is provided with at least one first damping component presenting a male element cooperating, at one of the ends of stroke, with a second damping component constituted by a ring floatingly mounted within a seating provided in the jack cylinder, said seating making possible radial wobbling of said ring, while the inner surface of said ring defines with the outer surface of said male element an annular clearance of variable section for the throttling of the hydraulic fluid, which hydraulic fluid, in the course of end-of-stroke damping, leaks from an annular chamber of variable volume, or damping chamber, delimited, in the axial direction, by an annular radial surface of said ring and by the opposed annular radial surface of the first component, said seating also making possible limited axial wobbling of said ring; said ring being hollowed out by through-going passages for re-supply of said damping chamber, said passages being hollowed out substantially parallel to the axis of the jack; and, in the damping condition, said passages are obturated, as a result of axial displacement of the ring, so as to isolate the damping chamber and render same independent of the remainder of the capacity of the jack, while, on return of the piston in the opposite direction after damping, said passages are freed so as to put the damping chamber into communication with the remainder of the capacity of the jack with the object of re-supplying said chamber with hydraulic fluid.

2. Hydraulic jack as set forth in claim 1, in which said passages are constituted by slots hollowed out in the periphery of the damping ring.

3. Hydraulic jack as set forth in claim 1, in which said passages are constituted by ducts pierced through the ring.

4. Hydraulic jack as set forth in claim 1, in which said passages open, at one of their ends, opposite a stationary annular surface integral with the jack and constituting the extreme wall of said seating against which the ring bears in the course of the damping in order to close in a fluid-tight manner said end of the passages and, at the other of their ends, said passages open into the damping chamber, opposite said opposed annular radial surface of the first component.

5. Hydraulic jack as set forth in claim 1, in which said first damping component comprises a male element associated with an intermediate element interposed between said male element and the piston of the jack, said intermediate element sliding with relative fluid-tightness in the jack cylinder.

6. Hydraulic jack as set forth in claim 5, in which said intermediate element is hollowed out by a groove and ducts for evacuation of leakages coming from the damping chamber.

7. Hydraulic jack as set forth in claim 6, in which a duct for directly re-supplying the passages is provided in a selected one of the component parts, cylinder and bottom, of the jack, said duct opening out near the surface of the ring situated opposite said stationary annular surface of the jack.

8. Hydraulic jack as set forth in claim 7, in which the duct for re-supplying the passages, located at one side of said ring, also constitutes the supply duct for the corresponding chamber of the jack, said ring being pierced by ducts of large section in direct communication with said corresponding chamber but not in communication with the damping chamber.

9. Hydraulic jack as set forth in claim 8 and of the differential double-acting type; in which it contains a damping system for each of the ends of stroke; the ducts for supply and evacuation of one of the chambers of the jack open into an annular clearance defined between the cylinder of the jack and an external jacket surrounding said cylinder, said clearance being connected to means for supply and reception of hydraulic fluid under pressure.

10. Hydraulic jack as set forth in claim 9 in which the stem of the jack is coupled to the movable contact of an electric circuit breaker.

* * * * *